US006299825B1

(12) United States Patent
Mitchell

(10) Patent No.: US 6,299,825 B1
(45) Date of Patent: Oct. 9, 2001

(54) WIRE TAKE-UP MECHANISM

(75) Inventor: John S. Mitchell, Hamilton (CA)

(73) Assignee: Stelco Inc., Ontario (CA)

( * ) Notice: Subject to any disclaimer, the term of this patent is extended or adjusted under 35 U.S.C. 154(b) by 0 days.

(21) Appl. No.: 09/487,647

(22) Filed: Jan. 19, 2000

(51) Int. Cl.[7] ..... C21D 9/62
(52) U.S. Cl. ..... 266/104; 148/601; 140/124
(58) Field of Search ..... 266/103, 104; 148/600, 601; 140/124

(56) References Cited

U.S. PATENT DOCUMENTS 3,494,568 * 2/1970 Bittman et al. ..... 140/124
3,695,543 * 10/1972 Stark ..... 242/82
4,161,415 * 7/1979 Van den Sype et al. ..... 148/601
4,204,885 * 5/1980 Van den Sype ..... 148/601
4,568,394 * 2/1986 Cassell ..... 148/600

FOREIGN PATENT DOCUMENTS 59-48359-A * 3/1984 (JP) .

* cited by examiner

*Primary Examiner*—Scott Kastler
(74) *Attorney, Agent, or Firm*—Alston & Bird LLP

(57) ABSTRACT

A process and apparatus is provided for forming spring wire into coils. A take-up block with a peripheral surface receives convolutions of wire as it is rotated. At least one pinch roll confines convolutions of the spring wire to the peripheral surface. The shape of the peripheral surface of the block and the circumferential surface of the pinch roll combine to define a gap for urging the convolutions of spring wire to migrate upward. At least one rotatable wire receiving basket is mounted adjacent the take-up block, and further drive means are provided for rotating the at least one wire receiving basket. In a preferred form, stationary guide loops are utilized to keep the spring wire moving in a predetermined trajectory from the take-up block to the rotating wire receiving basket. Again in a preferred embodiment, there are two wire receiving baskets, both rotated at a predetermined and adjustable speed, and the wire is wrapped into a coil firstly on one of the wire receiving baskets, and then on the other of the wire receiving basket. While each wire receiving basket is being filled, the coil of wire in the other can be removed.

18 Claims, 7 Drawing Sheets

WIRE TAKE-UP MECHANISM

This invention relates generally to mechanisms for handling oil-tempered spring wire.

BACKGROUND OF THIS INVENTION

Currently, vertical take-up systems for spring steel wire consist of a moveable platform on which a turntable is mounted. A carrier for receiving wire is placed on the turntable, with the centreline of the carrier located directly below a horizontal take-up block on the same vertical centreline. When the carrier is full, the wire is cut and the platform is moved to allow unloading of the full carrier and the placement of an empty one. During the changeover, the line is not stopped, which means that the length of wire produced during the changeover cycle must be scrapped.

Prior to the present development, sidewinder horizontal take-up blocks were used for oil-tempered spring steel wire. Sidewinder take-ups, representing a technology more than 80 years old, require great physical strength and exertion on the part of the operator, and are limited to small coil weights (<2,000 lbs.). The density of the finished coil is variable, depending upon the skill and strength of the operator. Wire breaks during take-up can result in serious injury to workers (and anyone standing close by) because the broken spring steel wire tends to fly off the block at high speed, and has extremely sharp edges.

GENERAL DESCRIPTION OF THIS INVENTION

In view of the disadvantages and drawbacks of the conventional technique, as set forth above, it is an object of one aspect of this invention to provide a process and apparatus for the take-up of spring steel wire which require less exertion on the part of the operator, which are adapted to produce coils of greater density and overall weight, and which are safer than the conventional arrangements.

More specifically, this invention provides an apparatus for forming spring wire into coils, comprising:

a take-up block in the general form of a drive wheel having a peripheral surface, the block being mounted for rotation about a substantially upright axis, so that convolutions of the wire can be wrapped around said peripheral surface, first drive means for rotating said block, at least one pinch roll defining a circumferential surface and mounted adjacent the periphery of said take-up block for movement between a first position in which the circumferential surface is adjacent the peripheral surface and a second position in which the circumferential surface is spaced away from the peripheral surface, biasing means for urging said at least one pinch roll toward the said first position, said peripheral and circumferential surfaces being configured to define a gap between them when the at least one pinch roll is in its first position, whereby convolutions of wire are contained in said gap, the peripheral surface sloping upwardly and inwardly so as to permit convolutions of wire wrapped around the peripheral surface of said wheel to move upwardly;

at least one rotatable wire receiving basket mounted adjacent the block, second drive means for rotating said at least one wire receiving basket, and guide means for guiding wire from the block to said at least one wire receiving basket.

Furthermore, this invention provides a process for wrapping spring wire into coils, comprising the steps:

feeding the wire to a take-up block having the general form of a drive wheel with a peripheral surface, the block being mounted for rotation about a substantially upright axis, such that convolutions of the wire are wrapped around said peripheral surface, rotating said block, maintaining the wire in contact with the peripheral surface by utilizing at least one pinch roll defining a circumferential surface and mounted adjacent the periphery of said take-up block for movement between a first position in which the circumferential surface is adjacent the peripheral surface and a second position in which the circumferential surface is spaced away from the peripheral surface, urging said at least one pinch roll toward the said first position, said peripheral and circumferential surfaces being configured to define a gap between them when the at least one pinch roll is in its first position, the peripheral surface sloping upwardly and inwardly, utilizing said sloping peripheral surface to urge convolutions of wire wrapped around the peripheral surface to migrate upward, providing at least one rotatable wire receiving basket mounted adjacent the block, rotating said at least one wire receiving basket, and guiding wire from the block to said at least one wire receiving basket.

Furthermore, this invention provides a process for wrapping spring wire into coils, comprising the steps:

feeding the wire to a take-up block having the general form of a drive wheel with a peripheral surface, the block being mounted for rotation about a substantially upright axis, such that convolutions of the wire are wrapped around said peripheral surface, rotating said block, maintaining the wire in contact with the peripheral surface by utilizing at least one pinch roll defining a circumferential surface and mounted adjacent the periphery of said take-up block for movement between a first position in which the circumferential surface is adjacent the peripheral surface and a second position in which the circumferential surface is spaced away from the peripheral surface, urging convolutions of wire wrapped around the peripheral surface to migrate upward, providing two rotatable wire receiving baskets mounted adjacent the block, rotating the wire receiving baskets, and guiding wire from the block alternatingly first to one wire receiving basket and then to the other wire receiving basket.

Finally, this invention provides an apparatus for forming spring wire into coils, comprising:

a take-up block in the general form of a drive wheel having a peripheral surface, the block being mounted for rotation about a substantially upright axis, so that convolutions of the spring wire can be wrapped around said peripheral surface, first drive means for rotating said block, at least one pinch roll defining a circumferential surface and mounted adjacent the periphery of said take-up block for movement between a first position in which the circumferential surface is adjacent the peripheral surface and a second position in which the circumferential surface is spaced away from the peripheral surface, biasing means for urging said at least one pinch roll toward the said first position, two wire receiving baskets mounted adjacent the block on opposite sides thereof, for rotation about substantially upright axes, the wire receiving baskets being at a level below that of the block, the block overlying a portion of each wire receiving basket, second drive means for rotating said wire receiving baskets, and guide means for guiding sequential lengths of wire alternatingly from the block to one of the wire receiving baskets and then from the block to the other of the wire receiving basket.

BRIEF DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
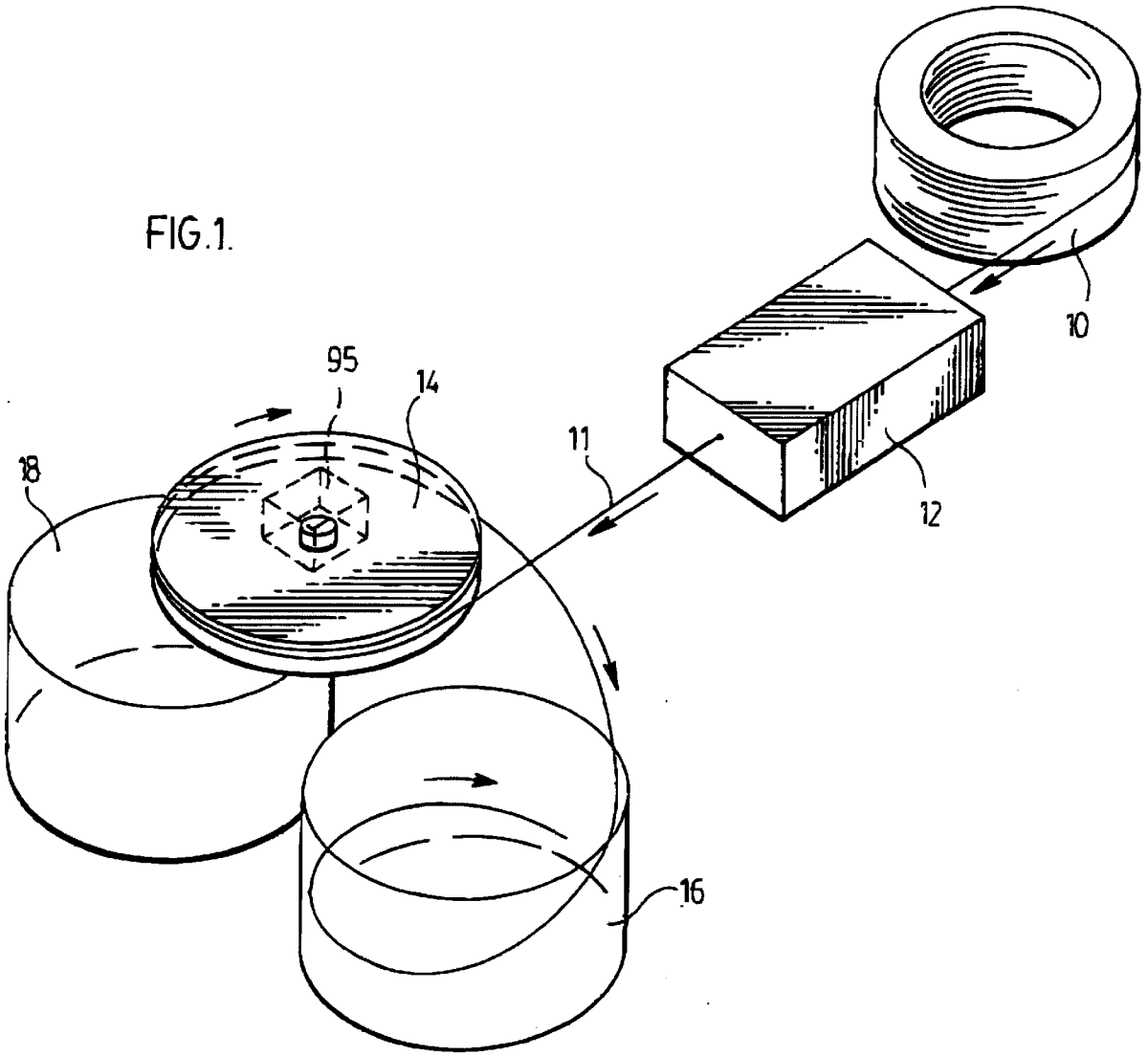
FIG. 1 is a generally schematic view of the main components of the take-up system according to the present invention.

FIG. 1 shows, in schematic form, an unquenched reel 10 of wire 11, an enclosure 12 containing means for heating, quenching and tempering the wire, a take-up block 14, and two wire receiving baskets 16 and 18 displaced to either side of the block 14, when viewed in the direction of movement of wire 11 being paid off the reel 10.

Figure 2:
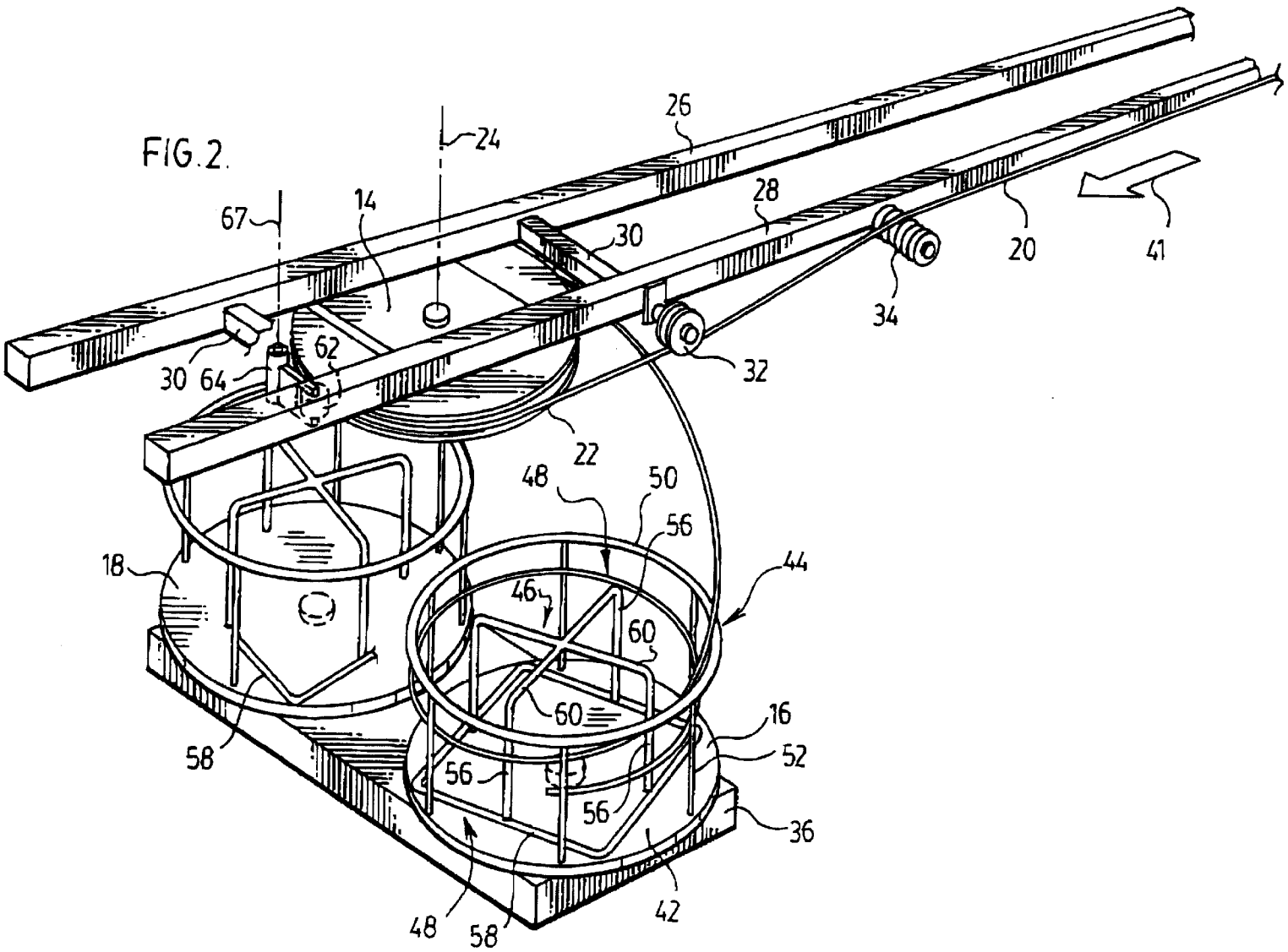
FIG. 2 is a view of the take-up portion of the apparatus shown in FIG. 1, in which greater detail is provided.

As can be seen in FIG. 2, the take-up block 14 has the configuration of a drive wheel having a peripheral surface 22. The take-up block 14 is mounted for rotation about a substantially upright (vertical) axis 24 by conventional bearing means not illustrated. The diameter of the wheel 14 is not so small that it causes the spring steel wire to be strained beyond its yield point.

In FIG. 2, two elongate frame members 26 and 28, fixed with respect to each other by cross-bracing 30, support two freely-turning idler pulleys 32 and 34. The wire 11 passes above the pulley 34 and below the pulley 32.

Figure 4:
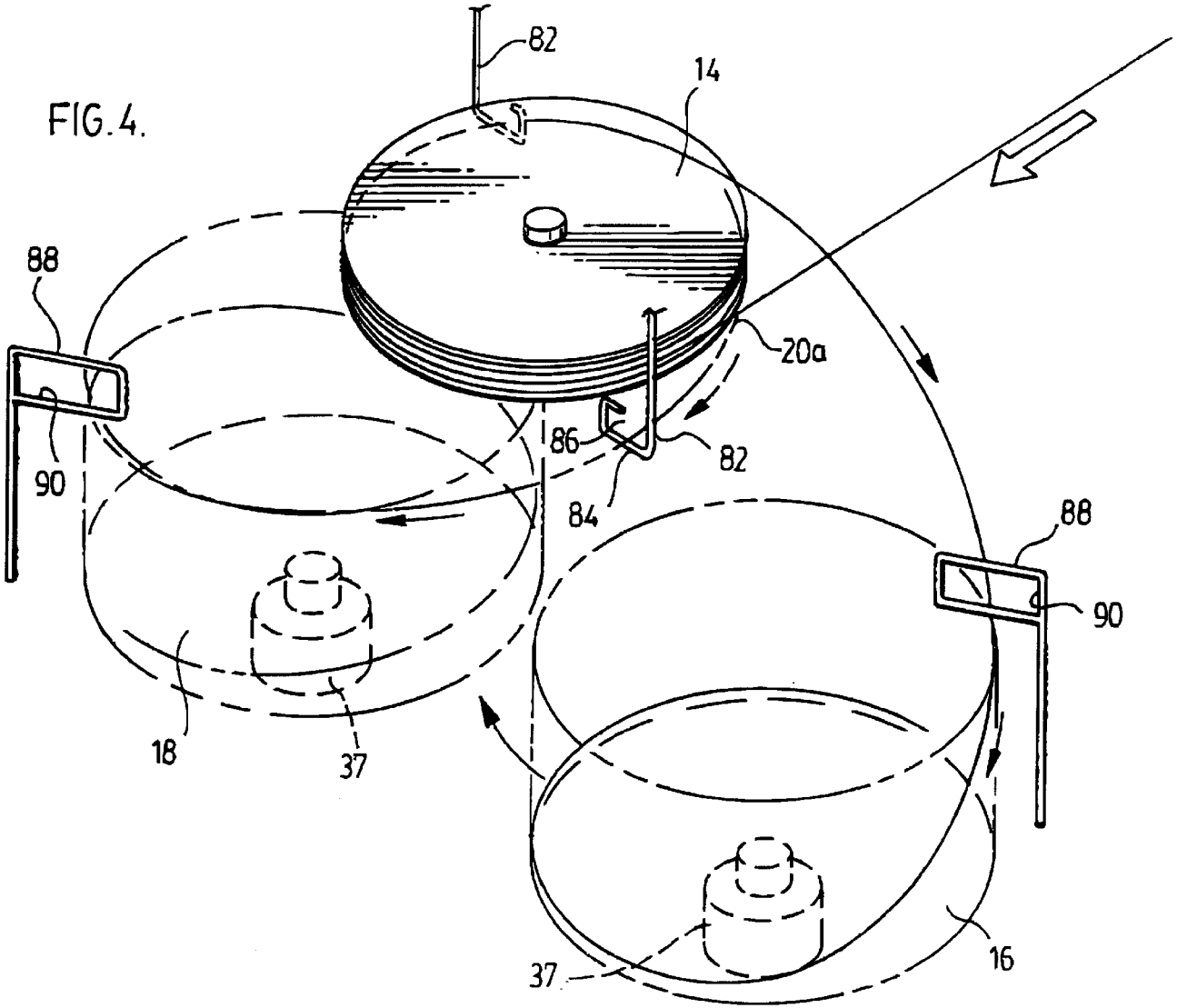
FIG. 4 is a schematic view showing how the initial convolutions of the wire are fed into the two wire receiving baskets.

A fixed platform 36 supports the wire receiving baskets 16 and 18, both of which wire receiving baskets are rotated, utilizing appropriate motors shown in broken lines at 37 in FIG. 4. Control of the speed of the platform motors 37 permits accommodation of wires of different diameters due to a change in line processing speeds. The wire receiving baskets 16 and 18 are positioned below the plane of the take-up block 14, and are displaced leftwardly and rightwardly with respect to the block axis 24 (as viewed in the direction of the arrow 41).

Attention is now directed to the rightward wire receiving basket 16 in FIG. 2, for a more detailed description. As can be seen, the wire carrier receiving basket 16 is resting on a circular base 42 and has an outer framework or cage 44 and an inner framework or wire carrier 46. Together, the frameworks 44 and 46 define for the basket an annular, upwardly open circular corridor 48, into which the wire 20 can be guided.

More particularly, the outer framework or cage 44 includes a substantially circular upper rim 50 and a plurality of outer upright posts 52 extending down from the circular upper rim 50 to the periphery of the circular base 42, the posts 52 resting on the base 42. The posts of the cage contain the outer wraps of wire to define the outer perimeter for the coil of wire. The wire is then allowed to seek a circumferential location in the basket which results in a minimum stress in the wire for that particular coil wrap. The inner framework 46 is a standard wire carrier which includes four inner upright posts 56 integral with base members 58 which rest on the circular base 42. The posts 56 are interconnected by cross-members 60. A significant advantage of this invention is that it permits the use of such standard wire carriers 46 and thereby avoiding fabrication of a custom wire carrier. The upright posts 56 define the inner circumference of the coil as each coil wrap in the basket seeks its least stressed position in the coil.

Figure 10:
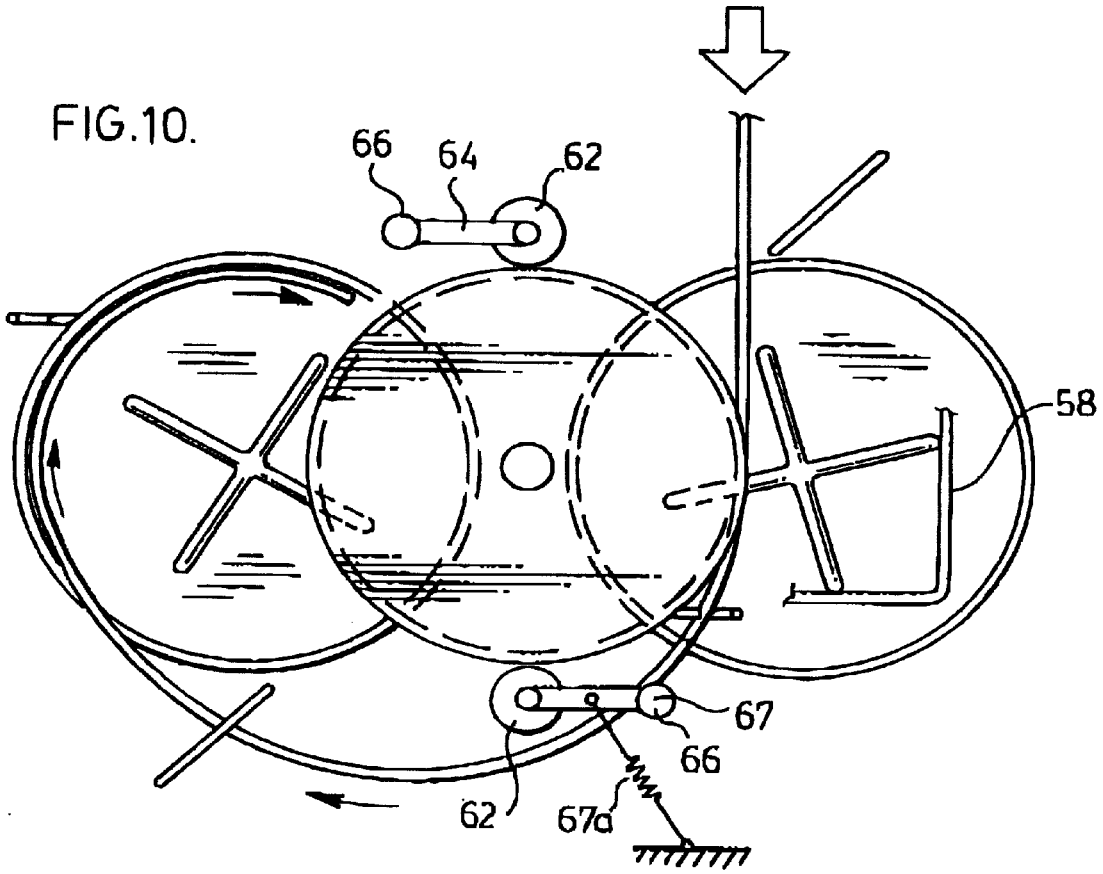
FIG. 10 is a view similar to FIG. 9, showing the introduction of the first convolution of wire into the other wire receiving basket.

Two pinch rolls 62 are provided, each of which is mounted for free rotation about a respective vertical axis 77 defined at one end of a fork member 64 extending radially from a cylindrical member 66 which is mounted for rotation about a vertical axis 67 fixed with respect to the frame defined by the frame members 26 and 28. See FIGS. 2, 3, 9 and 10. As seen in FIG. 10, a resilient means, shown schematically at 67*a*, biasses each pinch roll toward the take-up block 14.

Figure 3:
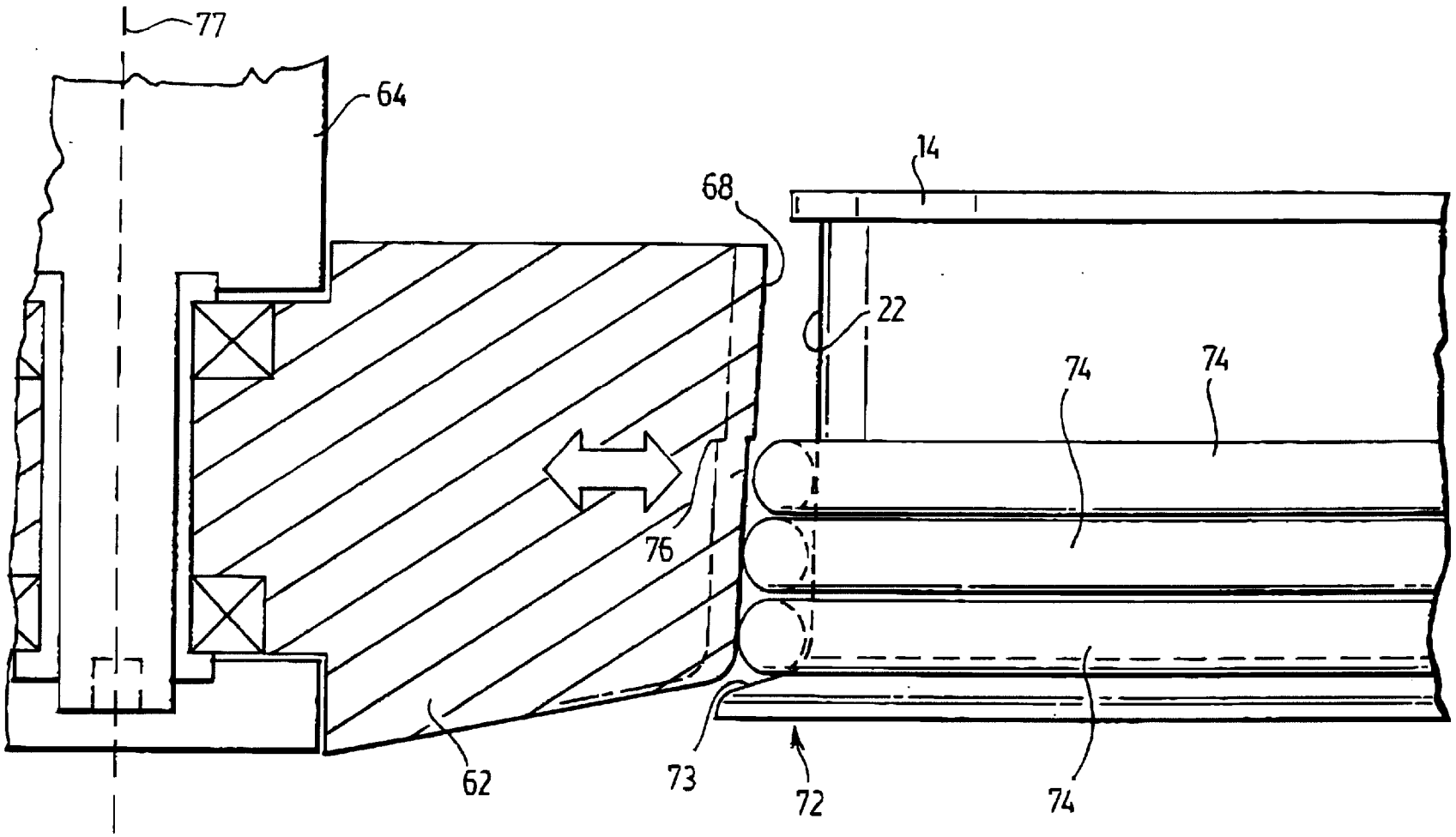
FIG. 3 is a sectional view through part of the main block and part of a pinch roll co-operating therewith.

Attention is now directed to FIG. 3, which illustrates adjacent portions of the take-up block 14 and one of the pinch rolls 62. As can be seen, although the take-up block 14 is essentially wheel-like in configuration, its peripheral surface 22 is slightly frusto-conical with the apex upward, which means that the surface 22, in an upward direction, slopes upwardly and inwardly towards the axis of the take-up block 14.

It can also be seen in FIG. 3 that the circumferential surface 68 of the pinch roll 62 is also slightly frusto-conical with its apex downward. This means that the peripheral surface 22 of the take-up block 14 and the circumferential surface 68 of the pinch roll 62 slope in the same direction and define thereby a gap 70 between them which also, as defined by the opposing surfaces 22 and 68, slopes upwardly and inwardly. The purpose of the sloping surface 22 is to urge convolutions of the spring steel wire 11, which progressively wrap around the peripheral surface 22 of the take-up block 14 from the bottom, to migrate upwardly. This inward slope of surface 22 also accommodates shrinkage of the wire due to cooling.

The take-up block 14 has a lower outwardly extending flange 72 located at the base of the sloping surface 22. The flange 72 is located slightly below the pinch roll 62, and has a circumferential portion 73 inclined relative to the upright axis 24 of take-up block 14 to support and urge convolutions 74 of the wire 11 to rise upwardly on sloping face 22.

A satisfactory slope angle for the surfaces 22 and 68 lies between about 1 degree and about 3 degrees.

As can be seen in FIG. 3, the circumferential surface 68 of each pinch roll 62 has an inward offset 76 near its vertical centre, such that the portion of the circumferential surface 68 below the offset 76 is displaced inwardly toward the axis 77 of the pinch roll 62 with respect to the portion of the circumferential surface 68 which lies above the offset. It has been found that this configuration for the pinch roll surface 68 is advantageous for containing the wire convolutions 74 and preventing them moving freely upwardly off the wheel surface 22.

The apparatus also includes guide means for guiding the wire in its trajectory from the take-up block 14 to the two wire receiving baskets 16 and 18. More specifically, with reference to FIGS. 4–7, the guide means includes two J-shaped spaced-apart guides 82, each providing a loop 84 with an opening 86 to allow the wire 11 a to be caught in the loop 84 or removed therefrom. The J-shaped guides 82 are located outwardly adjacent the take-up block 14 and are generally diametrically opposite each other. Each loop 84 is located somewhat below the plane of the take-up block 14, in order to allow the spring steel wire 11 a to pass smoothly into the respective wire receiving basket 16, 18.

Also illustrated in FIG. 4 are two P-shaped guides 88, each providing a closed loop 90. The closed nature of each loop 90 requires that the wire, in order to be engaged by the P-shaped guide 88, must be threaded through the loop after the wire has been cut. It will be noted that the P-shaped loops 88 are located adjacently above the respective wire receiving baskets, each being closer to the respective wire receiving basket than it is to the take-up block 14. This provides positive guidance for the wire as it pays off the take-up block 14 and approaches the wire receiving basket 16, 18.

Figure 5:
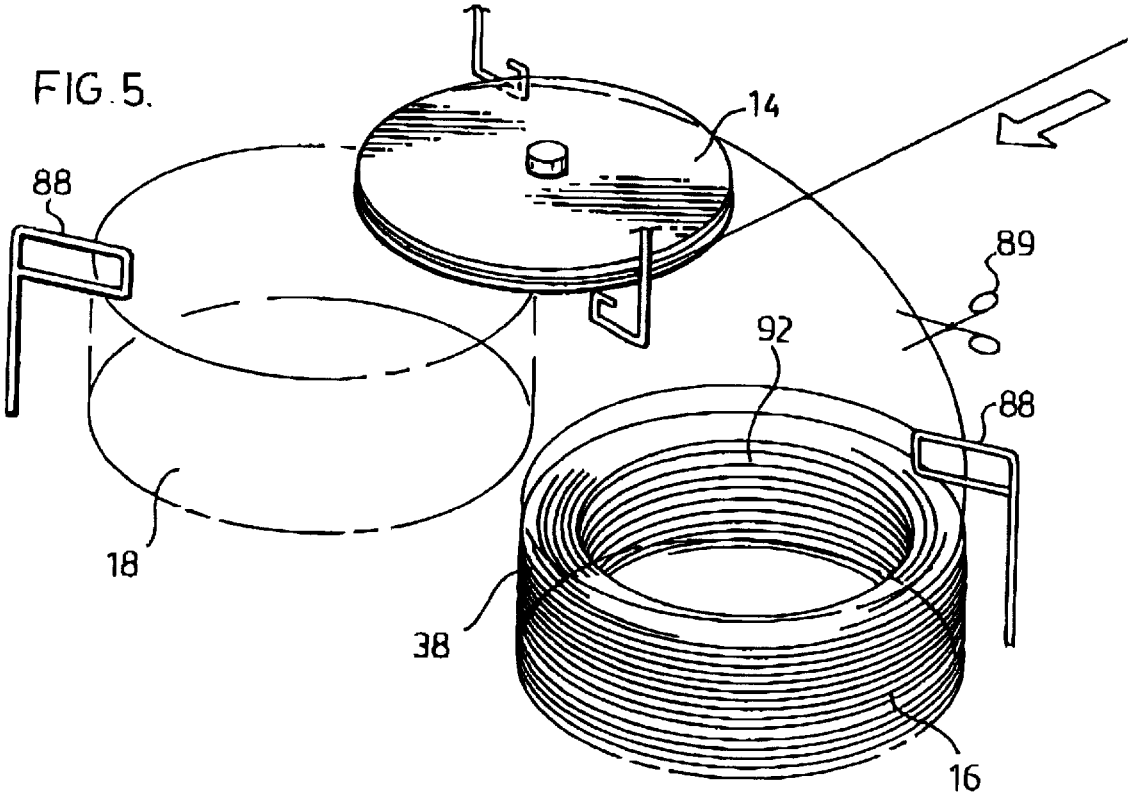
FIG. 5 is a schematic view similar to FIG. 4, showing the apparatus after a first coil of wire has been formed in the first wire receiving basket.
Figure 6:
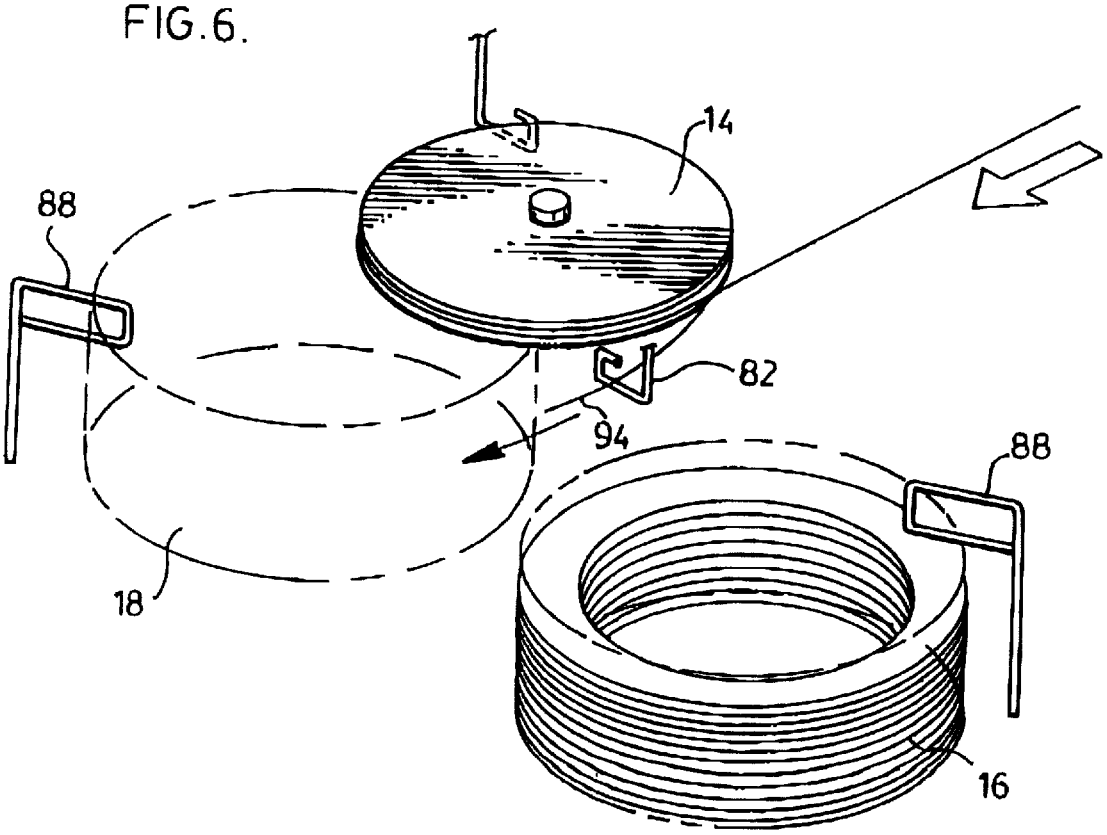
FIG. 6 is a view similar to FIG. 5, showing how the cut end of the wire is directed to the other wire receiving basket.
Figure 7:
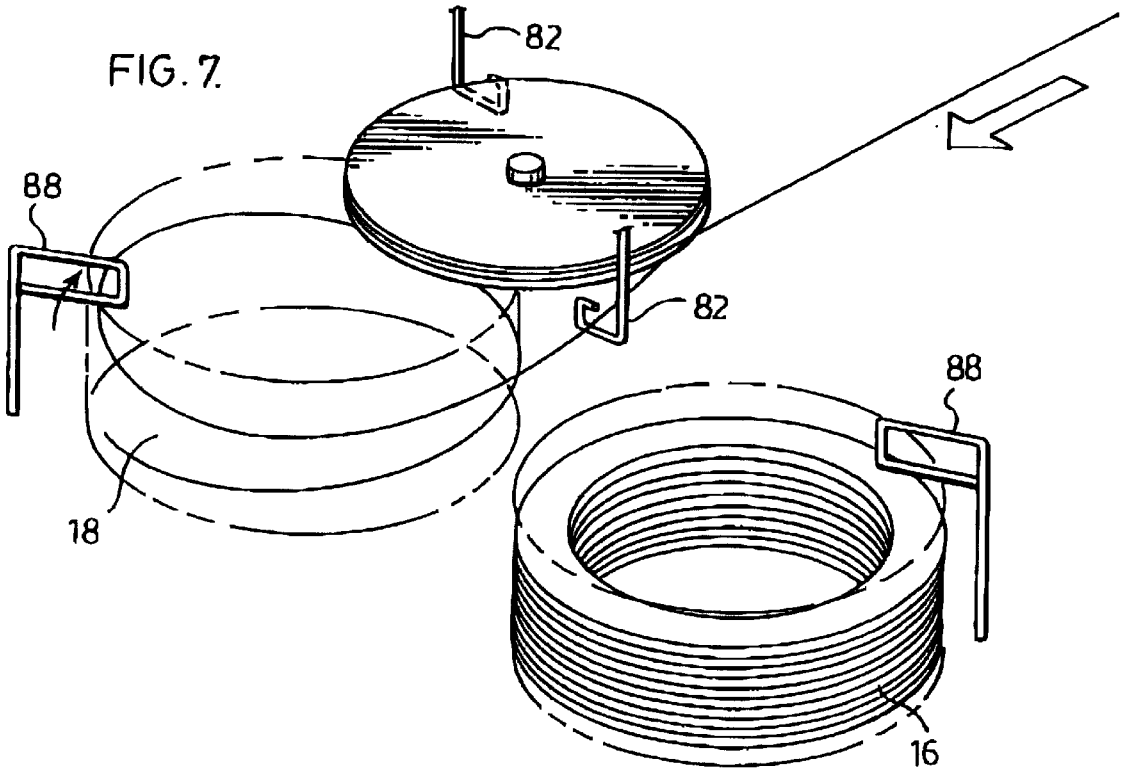
FIG. 7 is a schematic view similar to FIG. 6, showing how the first few convolutions of wire are introduced into the other wire receiving basket.
Figure 8:
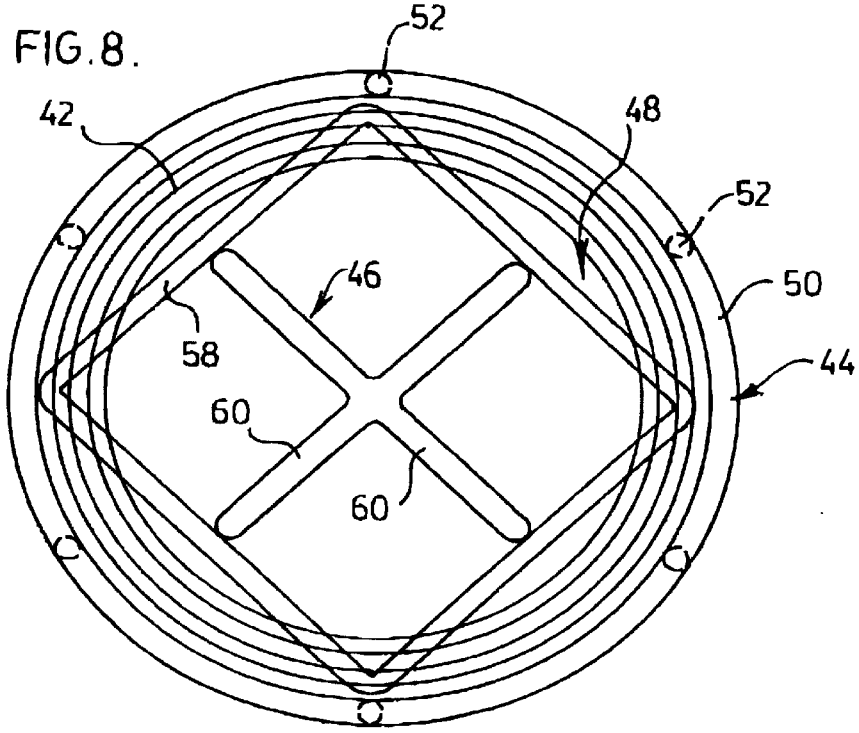
FIG. 8 is a plan view of a wire receiving basket for use with this invention.
Figure 9:
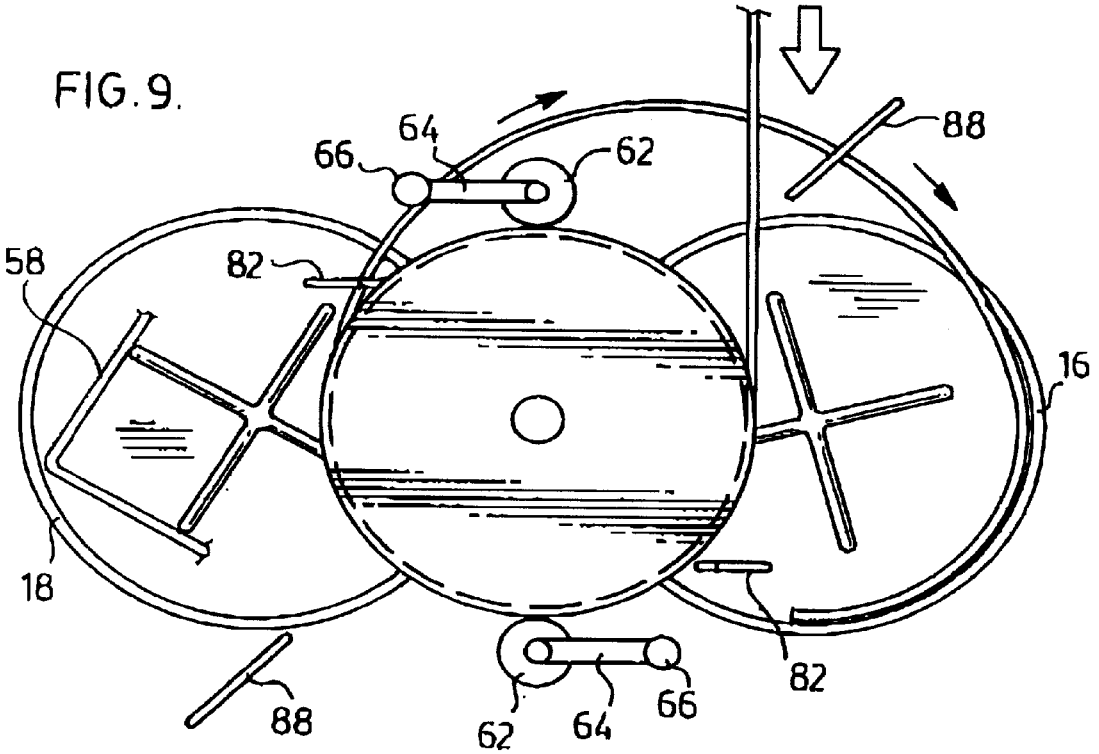
FIG. 9 is a schematic plan view showing how the first convolution of wire is fed into one of the wire receiving baskets.

Attention is now directed to FIGS. 5, 6 and 7, for a description of a portion of the operation of the apparatus thus far described.

In FIG. 5, it is assumed that the coil of wire in the rightward wire receiving basket 16 (initiated at lower right in FIG. 4) has been completed. Once completed, a severing mechanism (illustrated schematically as a wire cutters 89) cuts the wire at a location upstream of the rightward P-shaped guide 88. After the tail end of the cut wire passes through the P-shaped guide 88 and is tucked into the coil 92, the coil can be removed from the wire receiving basket 16.

Immediately upon severing of the wire, the new leading end 94 is placed within the rightward J-shaped guide 82, as pictured in FIG. 6, and is led toward the leftward wire receiving basket 18. The end 94 first passes through the leftward P-shaped guide 88 as seen in FIG. 7, and then enters the leftward wire receiving basket 18.

A process has thus been provided for storing a spring steel wire in relatively small coils, the wire proceeding from a larger source of such wire, such as the large reel 10 illustrated at the right in FIG. 1 with the numeral 10. The enclosure 12 contains means for heating, oil-quenching and tempering the spring steel wire, as aforesaid, and the wire 11 emerging from the enclosure 12 is then ready to be coiled in smaller lengths. Accordingly) the wire 11 is fed to the take-up block 14 which is rotated about its upright axis by conventional means shown schematically at 95, wrapping convolutions of the wire 20 around the peripheral surface 22 of the take-up block 14. The wire is maintained in contact with the peripheral surface 22 by pinch rolls 62 which define a circumferential surface and which are mounted adjacent the periphery 22 of the take-up block 14 for movement between a first position in which the circumferential surface is adjacent the peripheral surface, and a second position in which the circumferential surface is spaced away from the peripheral surface.

The pinch rolls 62 are urged toward their first positions by means 67*a* (FIG. 10). The peripheral and circumferential surfaces are configured to define the gap 70 mentioned earlier, the surfaces defining the gap sloping upwardly and inwardly. The gap 70 is utilized to contain convolutions of the wire wrapped around the peripheral surface of the take-up block 14 where sloping surface 22 urges the wire to migrate upward. The wire is then guided from the take-up block 14 to one of the wire receiving baskets 16, 18.

Generally speaking, a number of benefits and advantages flow from the process and structure described above.

Firstly, the take-up platform 36 for the wire receiving baskets 16 and 18 does not move. This means that it is simple in mechanical design and less expensive to build and maintain.

Secondly, the operator can switch from one wire carrier receiving basket to the other without having to stop the wire. The changeover is fast enough that no excess wire needs to be cut off while waiting for a new receiving basket to be moved into place. This eliminates the generation of unnecessary scrap.

Thirdly, the process and apparatus described herein is particularly suited to handling spring steel wire. The guides 82 and 88 urge but do not control the wire movement into the wire receiving baskets in a controlled manner thereby reducing the risk of injury.

Fourthly, the offset orientation of the wire receiving baskets with respect to the take-up block allows the wire to be introduced to the respective receiving basket at a laying angle which tends to produce a very dense and compact finished coil.

Finally, the system permits the use of the standard type of wire carrier where the weight of the wire coil may be much greater than the previous 1 ton limit and may now approach 3 tons.

While one embodiment of this invention has been illustrated in the accompanying drawings and described hereinabove, it will be evident to those skilled in the art that changes and modifications may be made thereto without departing from the essence of the invention, as set forth in the appended claims.

What is claimed is:

1. An apparatus for forming spring wire into coils, comprising:

a take-up block in the general form of a drive wheel having a peripheral surface, the block being mounted for rotation about a substantially upright axis, so that convolutions of the wire can be wrapped around said peripheral surface, first drive means for rotating said block, at least one pinch roll defining a circumferential surface and mounted adjacent the periphery of said take-up block for movement between a first position in which the circumferential surface is adjacent the peripheral surface and a second position in which the circumferential surface is spaced away from the peripheral surface, biasing means for urging said at least one pinch roll toward the said first position, said peripheral and circumferential surfaces being configured to define a gap between them when the at least one pinch roll is in its first position, the peripheral surface sloping upwardly and inwardly toward the axis of the block to urge convolutions of wire wrapped around the peripheral surface of said wheel to migrate upwardly, at least one rotatable wire receiving basket mounted adjacent the block, second drive means for rotating said at least one wire receiving basket, and guide means for guiding wire from the block to said at least one wire receiving basket.

2. The apparatus claimed in claim 1, in which the guide means includes at least one stationary loop mounted adjacent the block.

3. The apparatus claimed in claim 1, wherein the take-up block has a peripheral flange at a base portion of said peripheral surface, said flange defining an inclined portion relative to said upright axis to urge said wire convolutions upwardly of said surface.

4. The apparatus claimed in claim 1, in which the slope of the peripheral and circumferential surfaces lies between about 1 and about 3 degrees.

5. The apparatus claimed in claim 1, in which there are two rotatable wire receiving baskets, each wire receiving basket having an open top and an axis of revolution which is substantially upright, the wire receiving baskets being located on opposite sides of the block.

6. The apparatus claimed in claim 5, in which each wire carrier receiving basket has an outer framework and an inner framework, the outer and inner frameworks defining an annular, upwardly open corridor into which the wire can be guided.

7. The apparatus claimed in claim 6, in which said outer framework includes a substantially circular upper rim and a plurality of outer upright posts extending down from the circular upper rim to the periphery of said circular base, the posts resting on the base and defining the outer periphery of a wire coil, the inner framework being a wire carrier which defines the inner periphery of a wire coil.

8. The apparatus claimed in claim 1, in which the circumferential surface of the at least one pinch roll has an offset near its centre, such that the portion of the circumferential surface below the offset is displaced inwardly toward the axis of the pinch roll with respect to the portion of the circumferential surface above the offset.

9. The apparatus claimed in claim 1, in which there are two pinch rolls and two rotatable wire receiving baskets, the wire receiving baskets lying below the level of the block, and disposed such that the block overlaps a portion of each of the wire receiving baskets.

10. The apparatus claimed in claim 9, in which the guide means includes:

two J-shaped guides each providing a loop with an opening to allow the wire to be caught in the loop or removed therefrom, the J-shaped guides being adjacent the block and generally in diametrical opposition to each other, and two P-shaped guides each providing a closed loop requiring that one end of the wire be fed into the closed loop, the P-shaped loops being adjacent the wire receiving baskets, respectively, and having the function of guiding the entry of the wire into the wire receiving baskets.

11. In combination with the apparatus claimed in claim 1:

a first modality for heating spring steel wire, a second modality for oil quenching the wire, a third modality for tempering the quenched wire, and a fourth modality for directing the wire to the take-up block, thence altematingly to the wire receiving basket.

12. A process for wrapping spring wire into coils, comprising the steps:

feeding the wire to a take-up block having the general form of a drive wheel with a peripheral surface, the block being mounted for rotation about a substantially upright axis, such that convolutions of the wire are wrapped around said peripheral surface, rotating said block, maintaining the wire in contact with the peripheral surface by utilizing at least one pinch roll defining a circumferential surface and mounted adjacent the periphery of said take-up block for movement between a first position in which the circumferential surface is adjacent the peripheral surface and a second position in which the circumferential surface is spaced away from the peripheral surface, urging said at least one pinch roll toward the said first position, said peripheral and circumferential surfaces being configured to define a gap between them when the at least one pinch roll is in its first position, the gap sloping upwardly and inwardly toward the axis of the block, utilizing said gap to contain convolutions of wire wrapped around the peripheral surface, providing at least one rotatable wire receiving basket mounted adjacent the block, rotating said at least one wire receiving basket, and guiding wire from the block to said at least one wire receiving basket.

13. A process for wrapping spring wire into coils, comprising the steps:

feeding the wire to a take-up block having the general form of a drive wheel with a peripheral surface, the block being mounted for rotation about a substantially upright axis, such that convolutions of the wire are wrapped around said peripheral surface, rotating said block, maintaining the wire in contact with the peripheral surface by utilizing at least one pinch roll defining a circumferential surface and mounted adjacent the periphery of said take-up block for movement between a first position in which the circumferential surface is adjacent the peripheral surface and a second position in which the circumferential surface is spaced away from the peripheral surface, urging convolutions of wire wrapped around the peripheral surface to migrate upward, providing two rotatable wire receiving baskets mounted adjacent the block, rotating the wire receiving baskets, and guiding wire from the block alternatingly first to one wire receiving basket and then to the other wire receiving basket.

14. An apparatus for forming spring wire into coils, comprising:

a take-up block in the general form of a drive wheel having a peripheral surface, the block being mounted for rotation about a substantially upright axis, so that convolutions of the spring wire can be wrapped around said peripheral surface, first drive means for rotating said block, at least one pinch roll defining a circumferential surface and mounted adjacent the periphery of said take-up block for movement between a first position in which the circumferential surface is adjacent the peripheral surface and a second position in which the circumferential surface is spaced away from the peripheral surface, biasing means for urging said at least one pinch roll toward the said first position, two wire receiving baskets mounted adjacent the block on opposite sides thereof, for rotation about substantially upright axes, the wire receiving baskets being at a level below that of the block, the block overlying a portion of each wire receiving basket, second drive means for positively rotating said wire receiving baskets, and guide means for guiding sequential lengths of wire alternatingly from the block to one of the wire receiving baskets and then from the block to the other of the wire receiving baskets.

15. The apparatus claimed in claim 14, in which each wire receiving basket has a circular base, an outer framework and an inner framework, the base and the outer and inner frameworks defining an annular, upwardly open corridor into which the wire can be guided.

16. The apparatus claimed in claim 15, in which said outer framework includes a substantially circular upper rim and a plurality of outer upright posts extending down from the circular upper rim to the periphery of said circular base, the posts resting on the base; the inner framework including four inner upright posts resting on the base at the vertices of a hypothetical square concentric with the circular base, the top of each inner upright post being connected to the extremity of one of two cross-members of which the other end is connected to the upright post diagonally disposed with reference to the first-mentioned post, the two cross-members forming a cruciform shape.

17. The apparatus claimed in claim 1, in which each wire receiving basket has a circular base, an outer framework and an inner framework, the base and the outer and inner frameworks defining an annular, upwardly open corridor into which the wire can be guided.

18. The apparatus claimed in claim 17, in which said outer framework includes a substantially circular upper rim and a plurality of outer upright posts extending down from the circular upper rim to the periphery of said circular base, the posts resting on the base; the inner framework including four inner upright posts resting on the base at the vertices of a hypothetical square concentric with the circular base, the top of each inner upright post being connected to the extremity of one of two cross-members of which the other end is connected to the upright post diagonally disposed with reference to the first-mentioned post, the two cross-members forming a cruciform shape.

* * * * *

UNITED STATES PATENT AND TRADEMARK OFFICE

CERTIFICATE OF CORRECTION

PATENT NO. : 6,299,825 B1
DATED : October 9, 2001
INVENTOR(S) : Mitchell

It is certified that error appears in the above-identified patent and that said Letters Patent is hereby corrected as shown below:

Column 8,
Line 11, "altematingly" shodul read -- alternatingly --.

Signed and Sealed this

Nineteenth Day of March, 2002

*Attest:*

*Attesting Officer*

JAMES E. ROGAN
*Director of the United States Patent and Trademark Office*